US011465187B2

(12) United States Patent
Park et al.

(10) Patent No.: US 11,465,187 B2
(45) Date of Patent: Oct. 11, 2022

(54) BENT ROTOR STRAIGHTENING METHOD USING LOW FREQUENCY INDUCTION HEATING AND BENT ROTOR STRAIGHTENING APPARATUS USING SAME

(71) Applicants: KOREA ELECTRIC POWER CORPORATION, Naju-si (KR); KOREA MIDLAND POWER CO., LTD., Boryeong-si (KR);
(Continued)

(72) Inventors: Kwang-Ha Park, Daejeon (KR); Doo-Young Kim, Daejeon (KR); Hyun-Ku Park, Daejeon (KR); Jung-Hwan Kim, Daejeon (KR); Yong-Hee Jang, Daejeon (KR); Jun-Su Park, Daejeon (KR)

(73) Assignees: KOREA ELECTRIC POWER CORPORATION, Naju-si (KR); KOREA MIDLAND POWER CO., LTD., Boryeong-si (KR);
(Continued)

( * ) Notice: Subject to any disclaimer, the term of this patent is extended or adjusted under 35 U.S.C. 154(b) by 137 days.

(21) Appl. No.: 16/772,745

(22) PCT Filed: Mar. 20, 2019

(86) PCT No.: PCT/KR2019/003227
§ 371 (c)(1),
(2) Date: Jun. 12, 2020

(87) PCT Pub. No.: WO2020/054935
PCT Pub. Date: Mar. 19, 2020

(65) Prior Publication Data
US 2020/0338614 A1 Oct. 29, 2020

(30) Foreign Application Priority Data
Sep. 14, 2018 (KR) ..... 10-2018-0110172

(51) Int. Cl.
*B21D 3/16* (2006.01)
*B21D 37/16* (2006.01)

(52) U.S. Cl.
CPC ..... *B21D 3/16* (2013.01); *B21D 37/16* (2013.01)

(58) Field of Classification Search
CPC ... B21D 1/08; B21D 1/12; B21D 3/00; B21D 3/10; B21D 3/14; B21D 3/16; B21D 37/16
See application file for complete search history.

(56) References Cited

U.S. PATENT DOCUMENTS 3,598,665 A * 8/1971 Seulen ..... B21D 3/00 148/574
3,785,883 A * 1/1974 Seulen ..... B21D 3/00 148/572
(Continued)

FOREIGN PATENT DOCUMENTS

JP 2002-172411 A 6/2002
JP 2005-169458 A 6/2005
(Continued)

OTHER PUBLICATIONS

Hwangki Cho et al.. Multi-physics simulation of electromagnetic induction heating process for local straightening of bent rotors, The collected papers of 2017 conference of the Korean Society of Mechanical Engineers, 2017, pp. 3179-3184, vol. 11.
(Continued)

*Primary Examiner* — Edward T Tolan
(74) *Attorney, Agent, or Firm* — Foundation Law Group, LLP

(57) ABSTRACT

A bent rotor straightening method using low-frequency induction heating and a bent rotor straightening apparatus
(Continued)

using the method are proposed. The bent rotor straightening method using low-frequency induction heating according to an embodiment of the present invention includes: calculating a heating speed when a first target temperature for correcting bending of a rotor using low-frequency induction heating is set; maintaining the first target temperature for a heating time determined on the basis of a diameter of the rotor when the first target temperature is reached, when performing primary thermal correction at the heating speed; checking whether a bending amount of the rotor reaches a predetermined critical value in accordance the result of performing the primary thermal correction; and finishing correction of bending of the rotor in accordance with the result of checking the bending amount of the rotor.

21 Claims, 11 Drawing Sheets

(71) Applicants: KOREA WESTERN POWOR CO., LTD., Taean-gun (KR); KOREA SOUTH POWER CO., LTD., Busan (KR); KOREA EAST-WEST POWER CO., LTD., Ulsan (KR)

(73) Assignees: KOREA WESTERN POWER CO., LTD., Taean-Gun (KR); KOREA SOUTH POWER CO., LTD., Busan (KR); KOREA EAST-WEST POWER CO., LTD., Ulsan (KR)

(56) References Cited

U.S. PATENT DOCUMENTS

| | | | | |
|---|---|---|---|---|
| 4,442,331 | A * | 4/1984 | Watanabe | C21D 1/42 219/643 |
| 4,498,617 | A * | 2/1985 | Guertin | B23P 6/005 228/119 |
| 4,611,744 | A * | 9/1986 | Fraser | B23P 6/007 228/119 |
| 5,104,462 | A * | 4/1992 | Bishop | C21D 1/10 148/575 |
| 6,334,350 | B1 * | 1/2002 | Shin | B21D 11/20 72/342.5 |
| 2008/0276679 | A1 | 11/2008 | Eckerstorfer et al. | |
| 2014/0053404 | A1 * | 2/2014 | Johnson | E21B 17/00 29/888.021 |
| 2015/0122801 | A1 * | 5/2015 | Jones | H05B 6/42 219/602 |

FOREIGN PATENT DOCUMENTS

| | | | |
|---|---|---|---|
| JP | 2005-186111 | A | 7/2005 |
| JP | 2011-98393 | A | 5/2011 |
| KR | 10-2008-0072536 | A | 8/2008 |

OTHER PUBLICATIONS

Yunho Kim et al., Thermal deformation analysis of rotor straightening process using flame heating, The collected papers of 2017 conference of the Korean Society of Mechanical Engineers, 2017, pp. 3190-3193, vol. 11.

* cited by examiner

[A-A' CROSS-SECTION]

BENT ROTOR STRAIGHTENING METHOD USING LOW FREQUENCY INDUCTION HEATING AND BENT ROTOR STRAIGHTENING APPARATUS USING SAME

CROSS-REFERENCE TO RELATED APPLICATIONS

This application claims the benefit under 35 U.S.C. Section 371, of PCT International Application No. PCT/KR2019/003227, filed on Mar. 20, 2019, which claimed priority to Korean Patent Application No. KR10-2018-0110172, filed on Sep. 14, 2018, the disclosures of which are hereby incorporated by the references.

TECHNICAL FIELD

The present invention relates to a bent rotor straightening method using low-frequency induction heating and a bent rotor straightening apparatus using same and, more particularly, to a bent rotor straightening method using low-frequency induction heating that corrects bending of a rotor by removing residual stress generated by bending of the rotor, using low-frequency induction heating, and a bent rotor straightening apparatus using the method.

The present application claims priority to Korean Patent Application No. 10-2018-0110172, filed on Sep. 14, 2018, the entire contents of which are incorporated herein.

BACKGROUND ART

In power generation gas turbines, severe rubbing is generated between a rotor and a stator due to damage to the rotor, rubbing generated when they are started and stopped, inflow of water, etc., the rotor may be bent.

FIG. 1 is a view showing a mechanism causing a rotor to bend. A rotor partially expands due to a friction heat when rubbing is generated between the rotor and an external fixed member, and when the rotor is cooled, bending is generated due to residual stress.

When a rotor is bent, vibration of a power generation facility may increase, so it is required to stop the power generation facility and correct bending of the rotor. The degree of bending in such a rotor should be managed at a level of 0.2 mm or less because the rotor rotates at a high speed (about 3600 rpm).

Accordingly, it is required to straighten a rotor in order to partially correct only the bent portion of the rotor.

Straightening a rotor is classified into a method using a mechanical load and a method using a thermal load, but when a mechanical load is used, there is a large possibility of damage to the rotor on a contact surface, so the method using a thermal load is preferred.

As the method using a thermal load, there is a correction method using a thermal shelf and a correction method using a torch.

First, the correction method using a thermal shelf is not a method of partially heating a rotor, so blades may be damaged. Further, since this correction method has no variable that can control temperature, correction is performed through individual tests for various cases based on experiences, so correction takes a long time.

Next, the correction method using a torch is a method of partially heating a material using a torch, but it is difficult to heat only desired portions, so it is impossible to control the amount of deformation of a material. This correction method also performs correction through individual tests for various cases based on experiences, so correction may take a long time.

Accordingly, there is a need for a method that can apply a partial thermal load to a rotor and can correct a rotor within a short time using a manner that is advantages in temperature control in order to correct bending of the rotor.

DISCLOSURE

Technical Problem

An objective of the present invention is to provide a bent rotor straightening method using low-frequency induction heating that corrects bending of a rotor by removing residual stress generated by bending of the rotor, using low-frequency induction heating, and a bent rotor straightening apparatus using the method.

Technical Solution

A bent rotor straightening method using low-frequency induction heating according to an embodiment of the present invention includes: calculating a heating speed when a first target temperature for correcting bending of a rotor using low-frequency induction heating is set; maintaining the first target temperature for a heating time determined on the basis of a diameter of the rotor when the first target temperature is reached, when performing primary thermal correction at the heating speed; checking whether a bending amount of the rotor reaches a predetermined critical value in accordance the result of performing the primary thermal correction; and finishing correction of bending of the rotor in accordance with the result of checking the bending amount of the rotor.

According to an embodiment, the bent rotor straightening method may further include: setting a second target temperature for correcting bending of the rotor again using low-frequency induction heating; maintaining the second target temperature for a predetermined heating time when the second target temperature is reached, when secondary thermal correction is performed at the heating speed; checking whether a bending amount of the rotor reaches a predetermined critical value in accordance with the result of performing the secondary thermal correction; and finishing correction of bending of the rotor in accordance with the result of checking the bending amount of the rotor.

The first target temperature and the second target temperature may be determined as temperatures that give a margin at a phase change temperature of a material of the rotor.

When the phase change temperature of the material of the rotor is 700~800° C., the first target temperature may be 600~700° C. and the second target temperature may be 700° C.

The heating speed may be divided into a first heating period and a second heating period, in which temperature may be increased at 10~80° C./hr in the first heating period and may be increased at 10~50° C./hr in the second heating period.

A low-frequency induction coil may be wound on a partial bending portion of a rotor body of the rotor.

Low-frequency power of 500 Hz or less may be supplied to the low-frequency induction coil.

The low-frequency induction coil may be wound on a fireproof cover wound on the rotor body.

The low-frequency induction coil may have a double structure covering an outer surface of a coil layer with a cooling water layer.

A position of the rotor may be changed such that a bending portion faces up when the first thermal correction or the second thermal correction is performed.

The heating time determined in accordance with the diameter of the rotor at the first target temperature may be calculated and determined as 0.5~2 hours per 1 inch of the diameter of the rotor.

The predetermined heating time at the second target temperature may be 24 hours regardless of the diameter of the rotor.

The predetermined critical value may be 0.2 mm that is a bending amount at which the rotor is managed at about a standard bending degree or a correction ratio of a bending amount after correction to a bending amount before correction may be defined as 50%.

A bent rotor straightening apparatus according to an embodiment of the present invention includes: at least one processor; and a memory storing computer-readable commands, in which when the commands are executed by the at least one processor, the commands make a controller calculate a heating speed when a first target temperature for correcting bending of a rotor using low-frequency induction heating is set, maintain the first target temperature for a heating time determined on the basis of a diameter of the rotor when the first target temperature is reached, when performing primary thermal correction at the heating speed, check whether a bending amount of the rotor reaches a predetermined critical value in accordance the result of performing the primary thermal correction, and finish correction of bending of the rotor in accordance with the result of checking the bending amount of the rotor.

When the commands are executed by the at least one processor, the commands may make the bent rotor straightening apparatus set a second target temperature for correcting bending of the rotor again using low-frequency induction heating, maintain the second target temperature for a predetermined heating time when the second target temperature is reached, when secondary thermal correction is performed at the heating speed, check whether a bending amount of the rotor reaches a predetermined critical value in accordance with the result of performing the secondary thermal correction, and finish correction of bending of the rotor in accordance with the result of checking the bending amount of the rotor.

Advantageous Effects

The present invention can correct bending of a rotor by removing residual stress generated by bending of the rotor, using low-frequency induction heating.

Further, the present invention can control temperature using low-frequency induction heating, so it is possible to develop a procedure of straightening a rotor.

Further, the present invention can heat a partial bending portion requiring thermal straightening, so a thermal loss can be optimized.

Further, the present invention heats only a rotor, it is possible to prevent damage to blades due to correction.

Further, the present invention uses an elastic low-frequency induction coil, the present invention can be applied to correct bending of all kinds of rotors.

MODE FOR INVENTION

Figure 1:
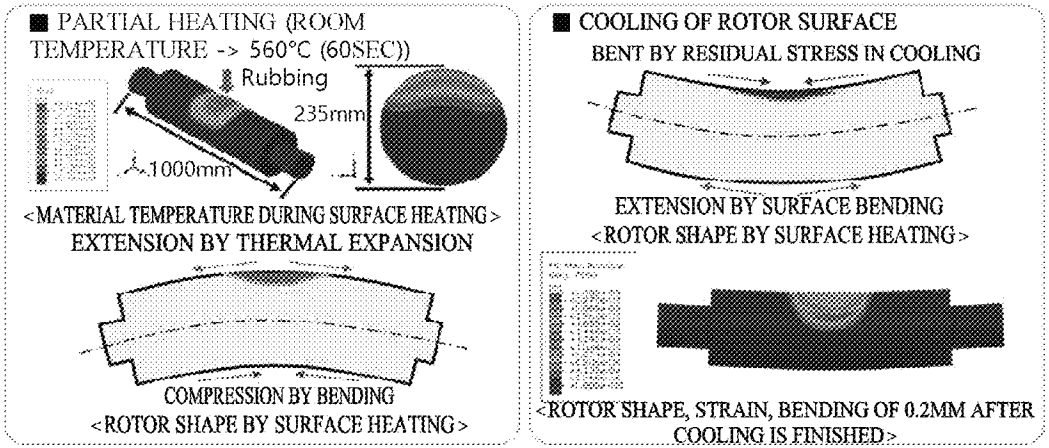
FIG. 1 is a view showing a mechanism causing a rotor to bend.

Hereinafter, exemplary embodiments of the present invention will be described in detail with reference to the accompanying drawings. However, well-known function or configurations that may make the spirit of the present invention unclear are not described in detail in the following description and the accompanying drawings. Further, it should be noted that the same components are given the same reference numerals in the drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the terms and words as terms for describing most appropriately the best method he or she knows for carrying out the invention.

Accordingly, the embodiments described herein and the configurations shown in the drawings are only most preferable embodiments of the present invention and do not represent the entire spirit of the present invention, so it should be appreciated that there may be various equivalents and modifications that can replace the embodiments and the configurations at the time at which the present application is filed.

In the accompanying drawings, comes configurations may be exaggerated, omitted, or schematically shown, and the sizes of the configurations do not fully reflect the actual sizes. The present invention is not limited to the relative sizes or gaps shown in the accompanying drawings.

Throughout the present specification, unless explicitly described otherwise, "comprising" any components will be understood to imply the inclusion of other components rather than the exclusion of any other components. Further, when an element is referred to as being "connected with" another element, it may be "directly connected" to the other element and may also be "electrically connected" to the other element with another element intervening therebetween.

Singular forms are intended to include plural forms unless the context clearly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Further, the term "~unit" used herein means a software component or a hardware component such FPGA, or ASIC and performs predetermined functions. However, the term "~unit" is not limited to software or hardware. A "unit" may be configured to be stored in a storage medium that can be addressed or may be configured to regenerate one or more processors. Accordingly, for example, the "unit" includes components such as software components, object-oriented software components, class components, and task components, processors, functions, properties, procedures, subroutines, segments of a program code, drivers, firmware, a microcode, a circuit, data, a database, data structures, tables, arrays, and variables. Functions provided by the components and the "units" may be combined in a smaller number of components and "units" or may be further separated into additional components and "units".

Hereafter, embodiments of the present invention will be described in detail with reference to the accompanying drawings such that those skilled in the art can easily accomplish the present invention. However, the present invention may be modified in various different ways and is not limited to the embodiments described herein. Further, in the accompanying drawings, components irrelevant to the description will be omitted in order to obviously describe the present invention, and similar reference numerals will be used to describe similar components throughout the specification.

Hereinafter, exemplary embodiments of the present invention will be described in detail with reference to the accompanying drawings.

A bent rotor straightening apparatus according to an embodiment of the present invention to be described hereafter may use a low-frequency heating manner rather than a high-frequency heating manner in consideration of the differences in characteristics between the high-frequency heating manner and the low-frequency heating manner shown in the following Table 1.

TABLE 1

| Items | Low-frequency heating manner | High-frequency heating manner |
|---|---|---|
| Advantages | Can control temperature using thermal treatment pattern<br>Can apply thermal treatment up to center of material<br>Low possibility by overheating in working | Can increase up to high temperature within short time<br>Light in comparison to low-frequency equipment |
| Disadvantages | Difficult to apply a lot of heat within short time<br>Heavy in comparison to high-frequency equipment | Large possibility of overheating when controlling gap between material and heater fails<br>Difficult to control temperature |

Figure 2:
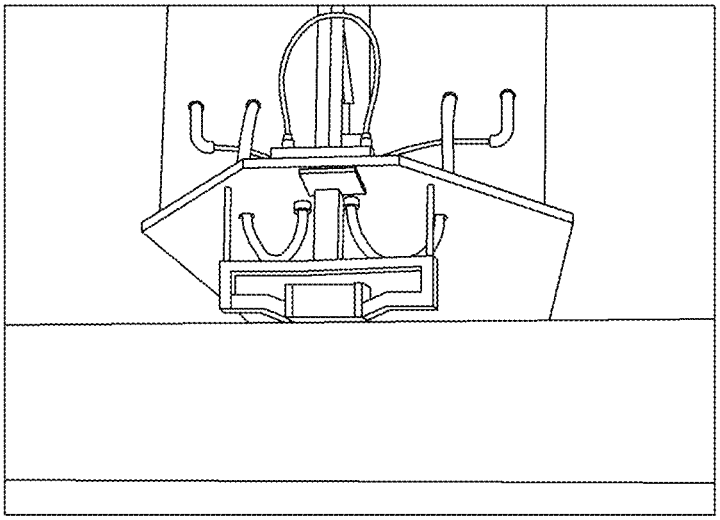
FIG. 2 is a view showing a bent rotor straightening apparatus using a high-frequency heating manner.
Figure 3:
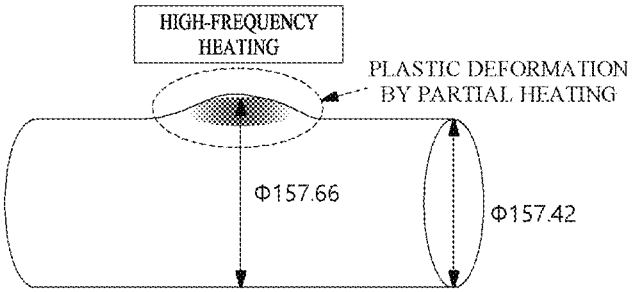
FIGS. 3A and 3B views showing partial plastic deformation due to high-frequency heating.
Figure 3:
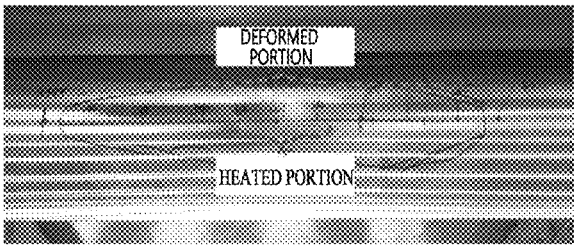
Figure 4:
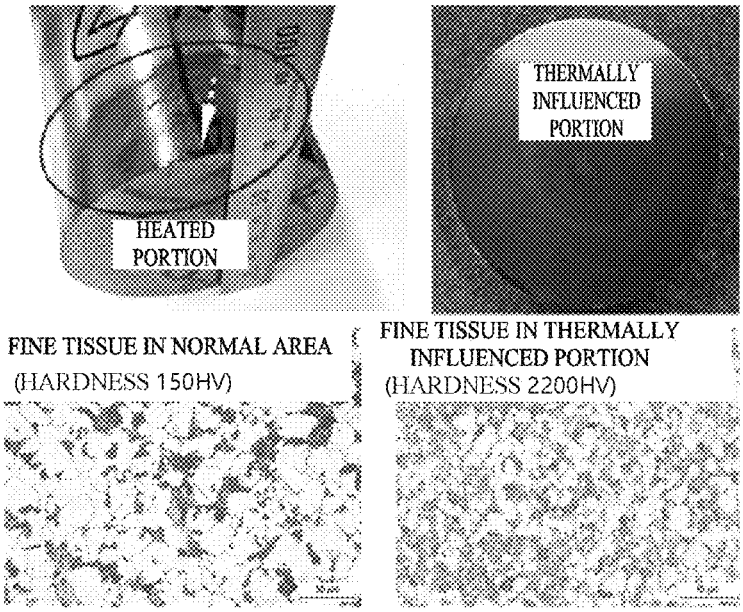
FIGS. 4A, 4B, 4C, and 4D tissue pictures by high-frequency heating.
Figure 5:
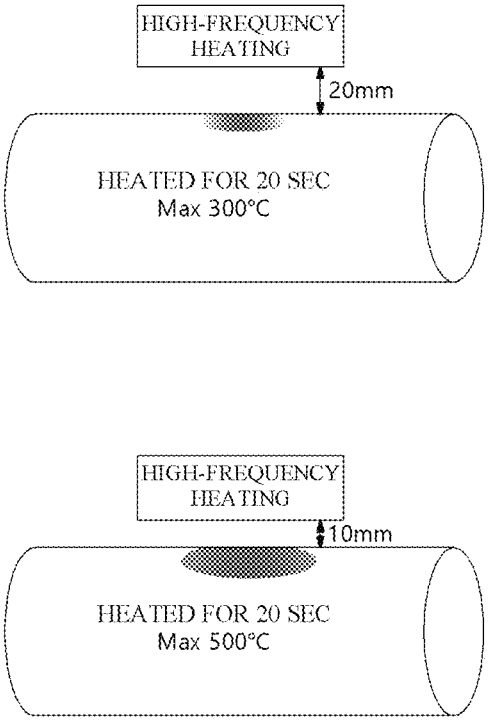
FIGS. 5A and 5B views showing temperature changes according to high-frequency heating gaps.
Figure 6:
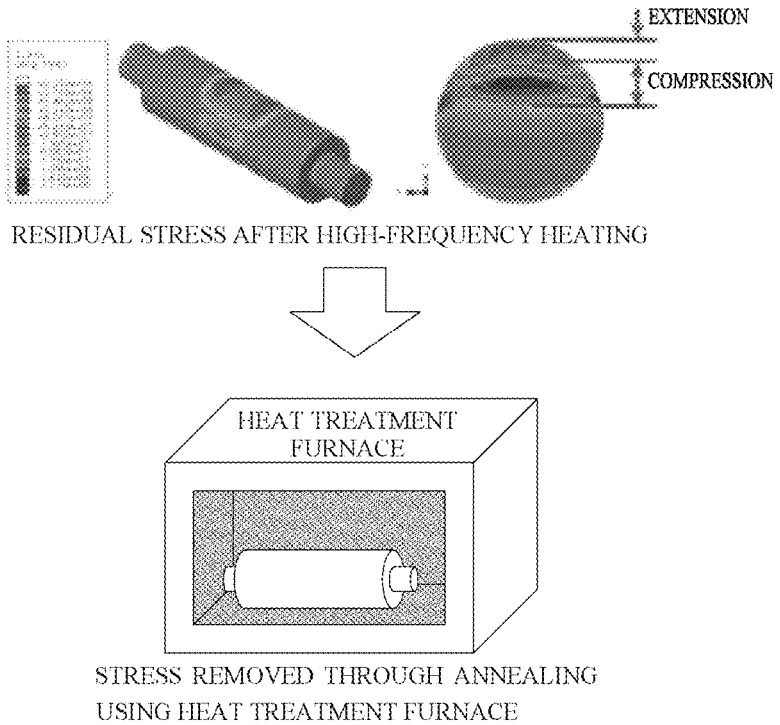
FIG. 6 is a view showing annealing against stress after high-frequency heating.

A bent rotor straightening apparatus using a high-frequency heating manner is described hereafter with reference to FIGS. 2 to 6, which shows the following characteristics. FIG. 2 is a view showing a bent rotor straightening apparatus using a high-frequency heating manner, FIGS. 3A and 3B views showing partial plastic deformation due to high-frequency heating, FIGS. 4A, 4B, 4C, and 4D tissue pictures by high-frequency heating, FIGS. 5A and 5B views showing temperature changes according to high-frequency heating gaps, and FIG. 6 is a view showing annealing against stress after high-frequency heating. As shown in FIG. 2, a bent rotor straightening apparatus using a high-frequency heating manner corrects thermal deformation by applying heating in a bending direction, using high-frequency heating, while being fixed to equipment.

This manner may make the entire material useless by generating plastic deformation due to partial heating on the surface of a rotor (see FIGS. 3A and 3B).

Further, this manner rapidly increases temperature within a short time (can increase 1000° C. within 60 seconds), so the tissues of a material may be changed (see FIGS. 4A, 4B, 4C, and 4D).

That is, this manner causes a rapid temperature change within a short time, so it is difficult to control temperature. For example, when a material is heated for 20 seconds by high-frequency heating, the temperature of the material may reach up to 300° C.

The high-frequency heating manner leaves a shallow thermally influenced portion in comparison to the low-frequency heating manner, so large residual stress is generated by a thermal difference in the high-frequency heating manner. Thermal stress is related with a temperature difference, as shown in the following Equation 1.

$$\text{Thermal stress}=(\text{modulus of elasticity})\times(\text{thermal expansion coefficient})\times(\text{temperature difference}) \quad \text{[Equation 1]}$$

That is, heat does not transfer to the deep part of a material in the high-frequency heating manner, but heat transfers up to the deep part of a material in the low-frequency heating manner. For this reason, large residual stress is shown due to a large thermal difference between the surface and the deep part in the high-frequency heating manner, while small residual stress is shown due to a small thermal difference in the low-frequency heating manner.

Further, a sensitive difference of an increase in temperature may be generated, depending on a high-frequency heating gap (see FIGS. 5A and 5B). As shown in FIGS. 5A and 5B, when a high-frequency heating gap is 20 mm, the temperature may reach maximally 300° C. in heating for 20 seconds, but when a high-frequency heating gap is 10 mm, the temperature may reach maximally 500° C. in heating for 20 seconds. As described above, it can be seen that this manner may show considerably different results, depending on the initial setting.

In the high-frequency heating manner, a rotor is heated in a direct contact state, the heater and the rotor may be damaged, so the rotor is heated with a predetermined heating gap secured.

Further, this manner causes residual stress, annealing is necessary to remove the stress (see FIG. 6). That is, there is always a possibility of re-deformation due to the residual stress unless annealing is performed to remove the stress in this manner.

Figure 7:
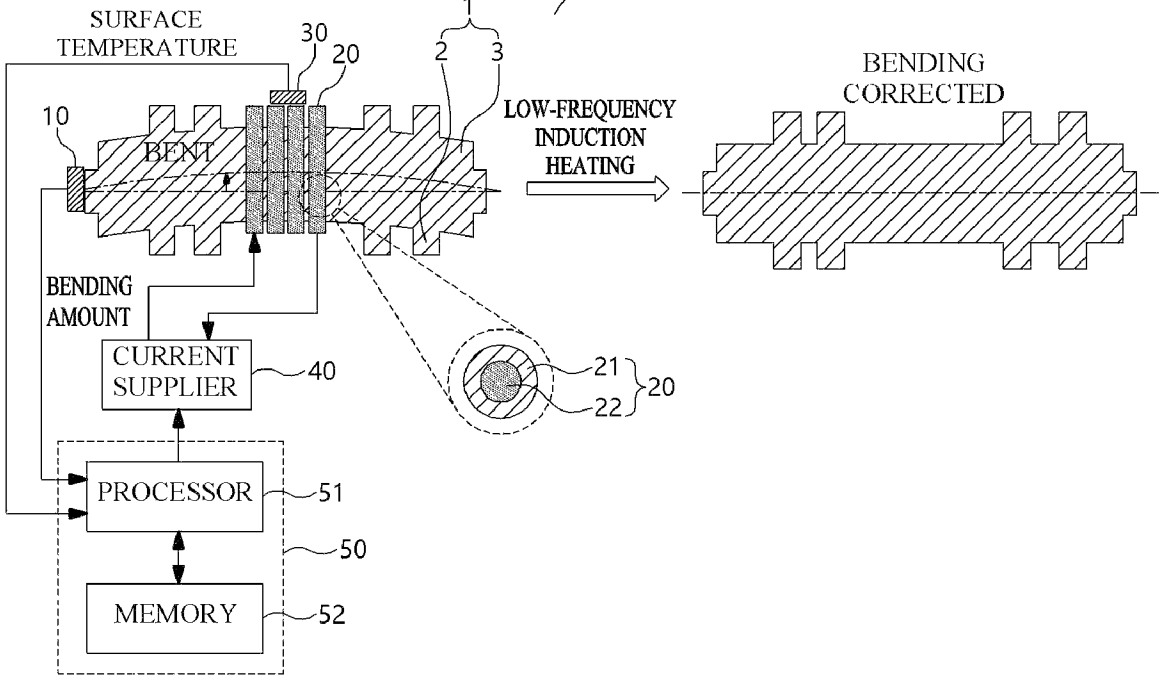
FIG. 7 is a view showing a bent rotor straightening apparatus according to an embodiment of the present invention.

FIG. 7 is a view showing a bent rotor straightening apparatus according to an embodiment of the present invention.

As shown in FIG. 7, a bent rotor straightening apparatus 100 according to an embodiment of the present invention can correct bending of a rotor 1 by removing residual stress that is generated by bending of the rotor 1, using low-frequency induction heating.

In detail, the bent rotor straightening apparatus 100 includes a bending amount measurer 10, a low-frequency induction coil 20, a temperature measurer 30, a current supplier 40, and a controller 50.

The low-frequency induction coil 20 has a double structure covering the outer surface of a coil layer 22 with a cooling water layer 21 to prevent damage to the coil layer 22.

Figure 8:
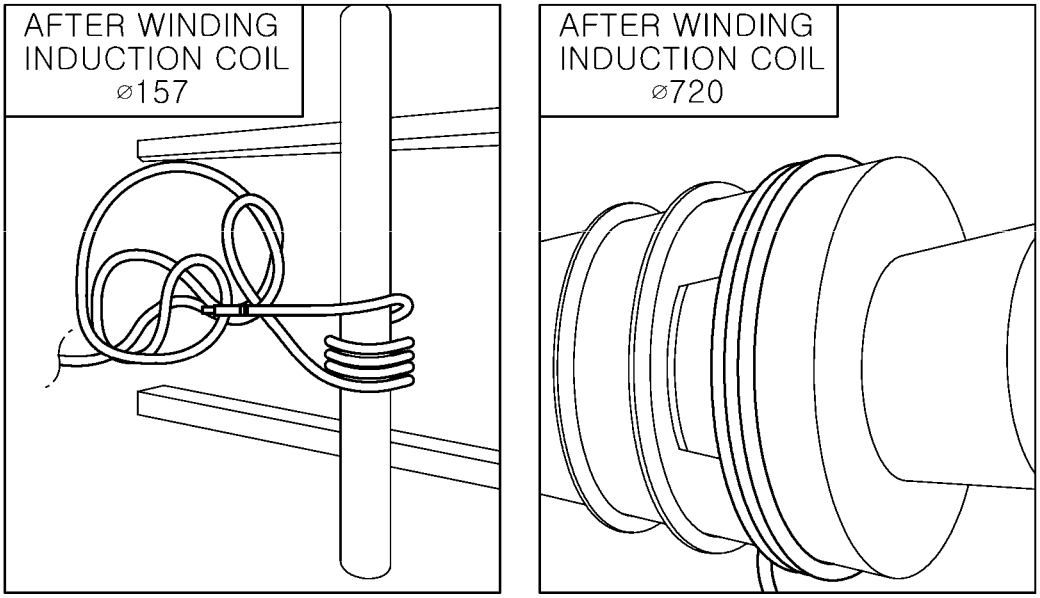
FIG. 8 is a view showing a wound state of a low-frequency induction coil.
Figure 9:
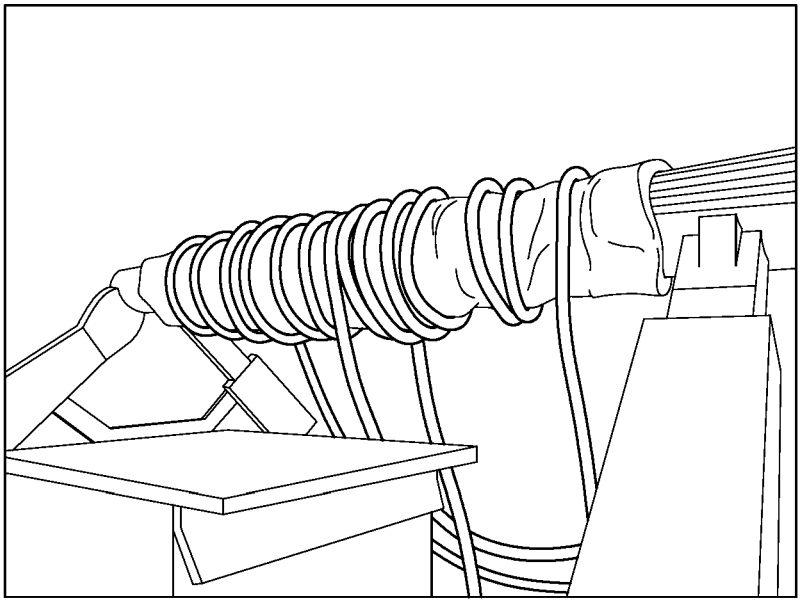
FIGS. 9A and 9B, and FIGS. 10A and 10B are views showing the case in which a fireproof cover wound between a low-frequency induction coil and a rotor body.
Figure 10:
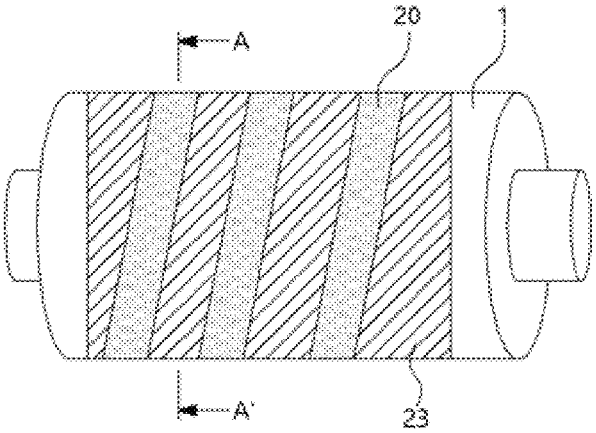
Figure 10:
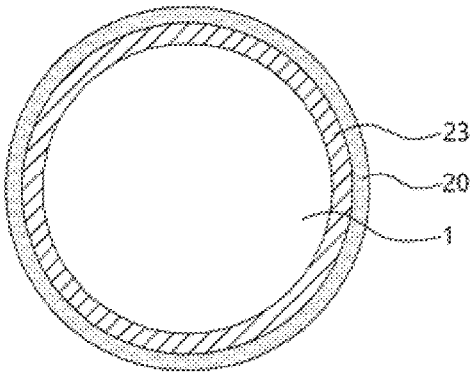

Further, the low-frequency induction coil 20 can be applied regardless of the diameter of the rotor 1 because it is directly wound on a partial bending portion of a rotor body 2 (see FIG. 8). FIG. 8 is a view showing a wound state of a low-frequency induction coil.

If a high-frequency heating manner is applied, the shape of an induction coil is avoidably fixed, so it is difficult to wind a coil, depending on the diameter of the rotor 1. That is, a high-frequency induction coil can be consequently applied to only one rotor.

Further, the low-frequency induction coil 20 may be wound on a fireproof cover 23 after the fireproof cover 23 is wound on the rotor body (see FIGS. 9A and 9B FIGS. 10A and 10B). FIGS. 9A and 9B FIGS. 10A and 10B are views showing the case in which a fireproof cover wound between a low-frequency induction coil and a rotor body. This is for maximizing a heat treatment effect by thermally insulating the fireproof cover 23 or preventing the low-frequency induction coil 20 from being damaged due to heat generated by induction heating.

As described above, since the low-frequency induction coil 20 partially heats a material, it does not cause damage to blades 3 of the rotor 1.

The controller 50 performs a predetermined heat treatment correction condition in accordance with the bending amount of the rotor 1 measured by the bending amount measurer 10. When performing the heat treatment correction condition, the controller 50 supplies a current to the low-frequency induction coil 20 by controlling the current supplier 40 in accordance with the surface temperature of the rotor body 2 measured by the temperature measurer 30. The current supplier 40 supplies low-frequency power of 500 Hz or less.

For example, the controller 50 calculates an increasing temperature per minute (e.g., an increase of 0.5° C. per minute) when a target temperature is set (an increase of 30° C. per hour up to 700° C.). Then, the controller 50 compares the measurement temperature measured by the temperature measurer 30 and the calculated calculation temperature. When the measurement temperature and the calculation temperature are different, the controller 50 controls the measurement temperature and the calculation temperature to be the same by increasing or decreasing the amount of a current that is applied to the low-frequency induction coil 20. Thereafter, the controller 50 maintains a predetermined state or stops when the target temperature (e.g., 700° C.) is reached.

To this end, the controller 50 includes at least one processor 51 and a memory 52 for storing computer-readable commands. The at least one processor 51 executes the computer-readable commands stored in the memory 52, thereby making the controller 50 perform the bent rotor straightening method using low-frequency induction heating.

Figure 11:
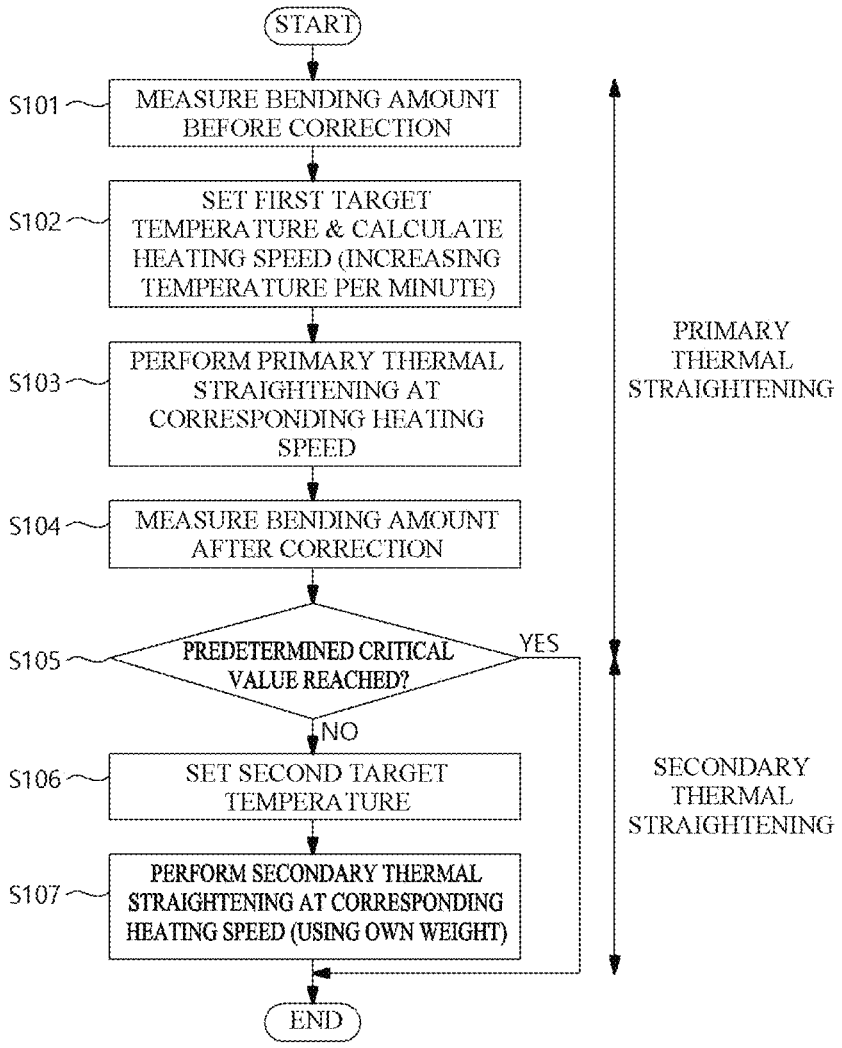
FIG. 11 is a view showing a bent rotor straightening method using low-frequency induction heating according to an embodiment of the present invention.
Figure 12:
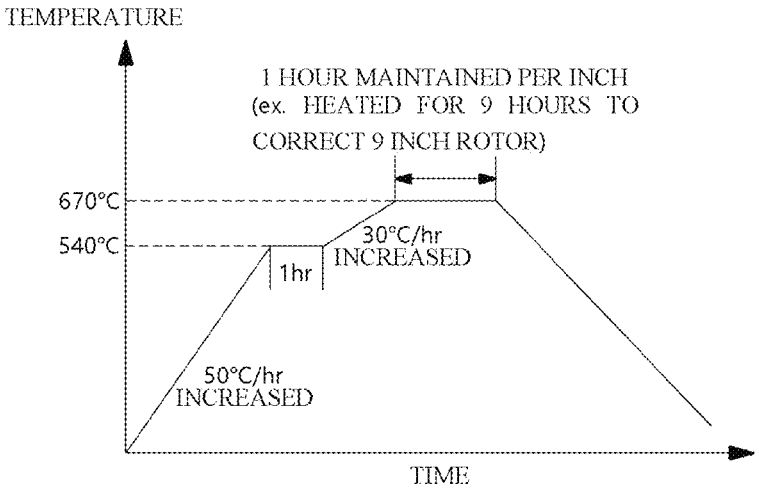
FIG. 12 is a view showing temperature and time of a primary thermal correction process of FIG. 11.
Figure 13:
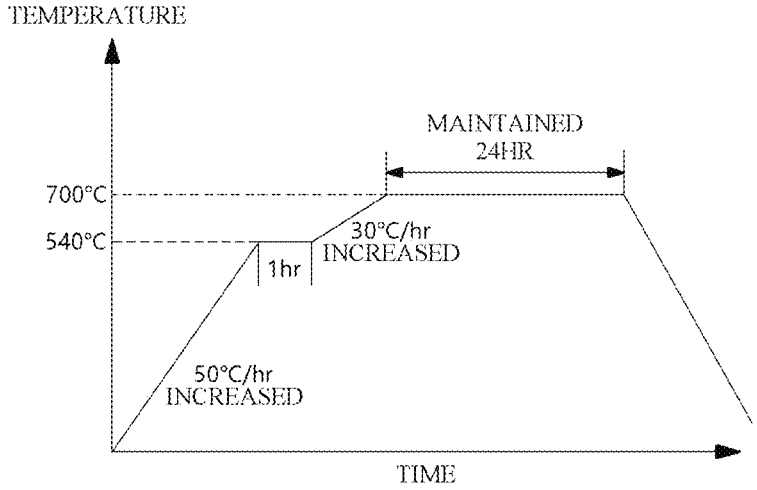
FIG. 13 is a view showing temperature and time of a secondary thermal correction process of FIG. 11.

FIG. 11 is a view showing a bent rotor straightening method using low-frequency induction heating according to an embodiment of the present invention, FIG. 12 is a view showing temperature and time of a primary thermal correction process of FIG. 11, and FIG. 13 is a view showing temperature and time of a secondary thermal correction process of FIG. 11.

As shown in FIG. 11, the bent rotor straightening apparatus 100 corrects bending of the rotor 1 using low-frequency induction heating.

First, the bent rotor straightening apparatus 100 performs primary thermal correction.

The bent rotor straightening apparatus 100 measures the bending amount before the rotor 1 is straightened (S101). Further, the bent rotor straightening apparatus 100 calculates a heating speed corresponding to an increasing temperature per minute when a first target temperature is set (S102).

First, as for the first target temperature, since the thermal conductivity and thermal property depend on materials, transformation temperatures depend on materials. The first target temperature is set in consideration of the characteristics of a material, and for example, may be determined in the range of 600~700° C.

Accordingly, a heating speed is divided into two periods, that is, the heating speed may be determined as 10~80° C./hr for a period of 0° C.~540° C. (i.e., a first period) and may be determined as 10~50° C./hr for a period of 540° C.~700° C. (i.e., a second heating period). Since when the thermal conductivity of materials is different, the amount of thermal stress depends on the heating speed, the heating speed is determined in consideration of the characteristics of materials.

The first target temperature may be determined as temperature that gives a margin of −100° C. or less at 700~800° C. that is the phase change temperature of the material of the rotor.

Thereafter, the bent rotor straightening apparatus 100 performs primary thermal correction at a corresponding heating speed (S103).

Referring to FIG. 12, the bent rotor straightening apparatus 100 determines the first target temperature as 670° C., increases the temperature of the surface of the rotor 1 at a heating speed of 50° C./hr in the period of 0° C.~540° C., maintains 540° C. for one hour, and then increases the temperature of the surface of the rotor 1 at a heating speed of 30° C./hr in the period of 540° C.~670° C. The first target temperature is determined as a temperature that gives a margin of −60° C. at 730° C. that is the phase change temperature of the material of the rotor.

Next, the bent rotor straightening apparatus 100 determined a heating time for maintaining 670° C. corresponding to the first target temperature in accordance with the diameter (inch) of the rotor 1. In this case, the heating time may be calculated as 0.5~2 hours per inch. For example, when the heating time is calculated as 1 hour per 1 inch of the diameter of the rotor 1, the heating time is 9 hours for 9 inches. That is, the bent rotor straightening apparatus 100 heats the rotor while maintaining the first target temperature for 9 hours.

Next, the bent rotor straightening apparatus 100 measures the bending amount after the rotor 1 is straightened (S104).

The bent rotor straightening apparatus 100 checks whether the bending amount of the rotor 1 reaches a predetermined critical value (S105). The critical value may be defined as 0.2 mm that is the bending amount at which the rotor 1 is managed at about a standard bending degree or the correction ratio of the bending amount after correction to the bending amount before correction may be defined as 50%.

When the predetermined critical value is reached, the bent rotor straightening apparatus 100 finishes correcting bending of the rotor 1 through primary thermal correction, but if not so, the bent rotor straightening apparatus 100 performs secondary thermal correction.

First, the bent rotor straightening apparatus 100 set a second target temperature (S106).

Referring to FIG. 13, the second target temperature is 700° C. and the heating speed is the same as that in the primary thermal correction. The second target temperature is determined as a temperature that gives a margin of −30° C. at 730° C. that is the phase change temperature of the material of the rotor.

Thereafter, the bent rotor straightening apparatus 100 performs second thermal correction at a corresponding heating speed (S107).

The bent rotor straightening apparatus 100 corrects bending using the weight of the rotor 1 (i.e., using the rotor's own weight). Accordingly, the position of the rotor 1 is changed such that the bending portion faces up. This can be applied to the primary thermal correction.

Referring to FIG. 13, the bent rotor straightening apparatus 100 increases the temperature of the surface of the rotor 1 at a heating speed of 50° C./hr in the period of 0° C.~540° C. (i.e., a first heating period), maintains 540° C. for one hour, and then increases the temperature of the surface of the rotor 1 at a heating speed of 30° C./hr in the period of 540° C.~700° C. (i.e., a second heating period).

Next, the bent rotor straightening apparatus 100 maintains 700° C. corresponding to the second target temperature for 24 hours regardless of the size of the diameter of the rotor 1.

As described above, the secondary thermal correction is performed with temperature maintained under 700° C. for along time, so there is no need for annealing against stress. This is heat treatment for stabilizing the tissues and stress, so stabilization is possible in terms of tissue.

Figure 14:
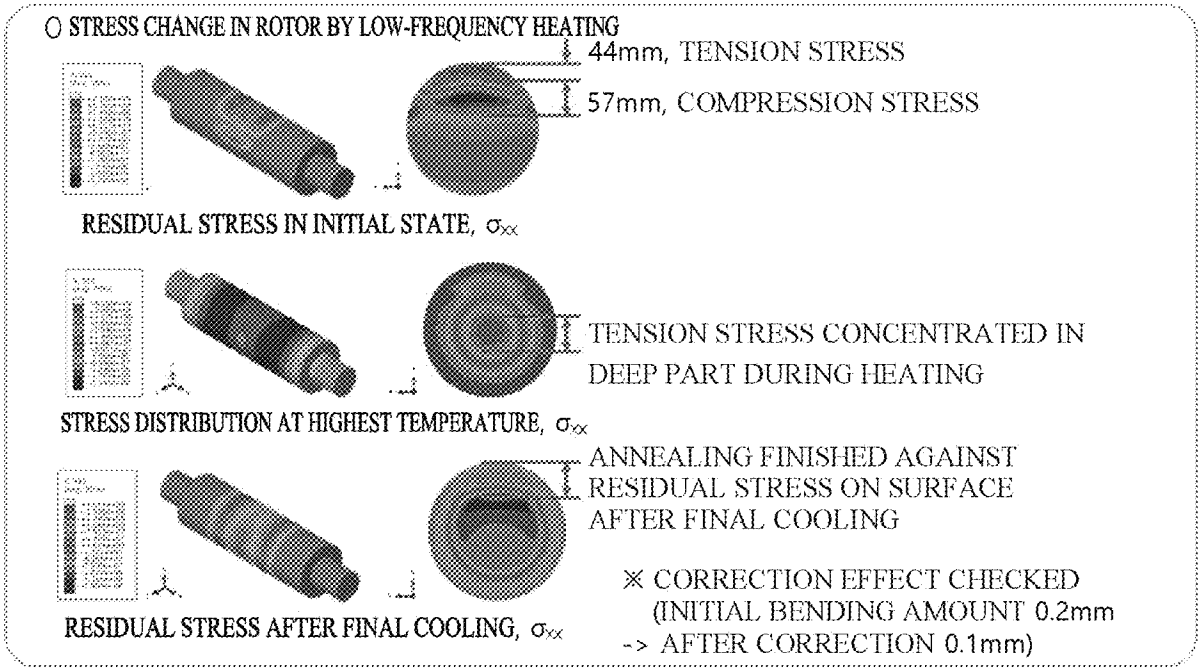
FIG. 14 is a view showing a stress change in a rotor by low-frequency bending.

FIG. 14 is a view showing a stress change in a rotor by low-frequency bending.

Referring to FIG. 14, residual stress exists in the rotor 1 in the initial state, but tension concentrates in the deep part by low-frequency heating and the residual stress on the surface is removed by annealing after final cooling, whereby a bending amount is corrected.

The method according to an embodiment may be implemented in a program that can be executed by various computers and may be recorded on computer-readable media. The computer-readable media may include program commands, data files, and data structures individually or in combinations thereof. The program commands that are recorded on the media may be those specifically designed and configured for the present invention or may be those available and known to those engaged in computer software in the art. The computer-readable recording media include magnetic media such as hard disks, floppy disks, and magnetic media such as a magnetic tape, optical media such as CD-ROMs and DVDs, magneto-optical media such as floptical disks, and hardware devices specifically configured to store and execute program commands, such as ROM, RAM, and flash memory. The program commands include not only machine language codes compiled by a compiler, but also high-level language code that can be executed by a computer using an interpreter etc.

Although above description addresses new characteristics of the present invention that are applied to various embodiments, it will be understood by those skilled in the art that the configuration and details of the device and method described above may be removed, replaced, and modified in various way without departing from the scope of the present invention. Accordingly, the scope of the preset invention is defined by the following claims rather than the above description. All modifications within equivalent ranges to the claims are included in the scope of the present invention.

The invention claimed is:

1. A bent rotor straightening method using low-frequency induction heating, the bent rotor straightening method comprising:

calculating a heating speed when a first target temperature for correcting bending of a rotor using low-frequency induction heating is set;

maintaining the first target temperature for a heating time determined on the basis of a diameter of the rotor when the first target temperature is reached, when performing primary thermal correction at the heating speed;

checking whether a bending amount of the rotor reaches a predetermined critical value in accordance the result of performing the primary thermal correction; and finishing correction of bending of the rotor in accordance with the result of checking the bending amount of the rotor, wherein the primary thermal correction is executed by a measurement temperature and a calculation temperature which calculates an increasing temperature per minute, and the bending amount of the rotor is generated by measuring the rotor.

2. The bent rotor straightening method of claim 1, further comprising:

setting a second target temperature for correcting bending of the rotor again using low-frequency induction heating;

maintaining the second target temperature for a predetermined heating time when the second target temperature is reached, when secondary thermal correction is performed at the heating speed;

checking whether a bending amount of the rotor reaches a predetermined critical value in accordance with the result of performing the secondary thermal correction; and finishing correction of bending of the rotor in accordance with the result of checking the bending amount of the rotor.

3. The bent rotor straightening method of claim 2, wherein the first target temperature and the second target temperature are determined as temperatures that give a margin at a phase change temperature of a material of the rotor.

4. The bent rotor straightening method of claim 3, wherein when the phase change temperature of the material of the rotor is 700~800° C., the first target temperature is 600~700° C. and the second target temperature is 700° C.

5. The bent rotor straightening method of claim 2, wherein the heating speed is divided into a first heating period and a second heating period, wherein temperature is increased at 10~80° C./hr in the first heating period and is increased at 10~50° C./hr in the second heating period.

6. The bent rotor straightening method of claim 1, wherein a low-frequency induction coil is wound on a partial bending portion of a rotor body of the rotor.

7. The bent rotor straightening method of claim 6, wherein low-frequency power of 500 Hz or less is supplied to the low-frequency induction coil.

8. The bent rotor straightening method of claim 6, wherein the low-frequency induction coil is wound on a fireproof cover wound on the rotor body.

9. The bent rotor straightening method of claim 6, wherein the low-frequency induction coil has a double structure covering an outer surface of a coil layer with a cooling water layer.

10. The bent rotor straightening method of claim 2, wherein a position of the rotor is changed such that a bending portion faces up when the first thermal correction or the second thermal correction is performed.

11. The bent rotor straightening method of claim 1, wherein the heating time determined in accordance with the diameter of the rotor at the first target temperature is calculated and determined as 0.5~2 hours per 1 inch of the diameter of the rotor.

12. The bent rotor straightening method of claim 2, wherein the predetermined heating time at the second target temperature is 24 hours regardless of the diameter of the rotor.

13. The bent rotor straightening method of claim 1, wherein the predetermined critical value is 0.2 mm that is a bending amount at which the rotor is managed at about a standard bending degree or a correction ratio of a bending amount after correction to a bending amount before correction is defined as 50%.

14. A bent rotor straightening apparatus comprising:

at least one processor; and a memory storing computer-readable commands, wherein when the commands are executed by the at least one processor, the commands make a controller calculate a heating speed when a first target temperature for correcting bending of a rotor using low-frequency induction heating is set, maintain the first target temperature for a heating time determined on the basis of a diameter of the rotor when the first target temperature is reached, when performing primary thermal correction at the heating speed, check whether a bending amount of the rotor reaches a predetermined critical value in accordance the result of performing the primary thermal correction, and finish correction of bending of the rotor in accordance with the result of checking the bending amount of the rotor, wherein the primary thermal correction is executed by a measurement temperature and a calculation temperature which calculates an increasing temperature per minute, and the bending amount of the rotor is generated by measuring the rotor.

15. The bent rotor straightening apparatus of claim 14, wherein when the commands are executed by the at least one processor, the commands make the bent rotor straightening apparatus set a second target temperature for correcting bending of the rotor again using low-frequency induction heating, maintain the second target temperature for a predetermined heating time when the second target temperature is reached, when secondary thermal correction is performed at the heating speed, check whether a bending amount of the rotor reaches a predetermined critical value in accordance with the result of performing the secondary thermal correction, and finish correction of bending of the rotor in accordance with the result of checking the bending amount of the rotor.

16. The bent rotor straightening apparatus of claim 15, wherein the first target temperature and the second target temperature are determined as temperatures that give a margin at a phase change temperature of a material of the rotor.

17. The bent rotor straightening apparatus of claim 16, wherein the phase change temperature of the material of the rotor is 730° C., the first target temperature is 670° C., and the second target temperature is 700° C.

18. The bent rotor straightening apparatus of claim 15, wherein the heating speed is divided into a first heating period and a second heating period, wherein temperature is increased at 50° C./hr in the first heating period and is increased at 30° C./hr in the second heating period.

19. The bent rotor straightening apparatus of claim 14, wherein a low-frequency induction coil is wound on a partial bending portion of a rotor body of the rotor.

20. The bent rotor straightening apparatus of claim 19, wherein low-frequency power of 500 Hz or less is supplied to the low-frequency induction coil.

21. The bent rotor straightening apparatus of claim 19, wherein the low-frequency induction coil is wound on a fireproof cover wound on the rotor body.

* * * * *